US009809425B2

(12) United States Patent
Kupferschmid et al.

(10) Patent No.: US 9,809,425 B2
(45) Date of Patent: Nov. 7, 2017

(54) BIONIC STEP

(71) Applicants: Georg Fischer Automotive (Suzhou) Co., Ltd., Suzhou (CN); Georg Fischer GmbH, Werdohl (DE); Georg Fischer Druckguss GmbH, Herzogenburg (AT); Georg Fischer GmbH & Co KG, Altenmarkt, St. Gallen (AT)

(72) Inventors: Roger Kupferschmid, Hemishofen (CH); Dominik Mahnig, Schaffhausen (CH); Udo Kreutzarek, Singen (DE); Marek Socha, Singen (DE)

(73) Assignees: Georg Fischer Automotive (Suzhou) Co., Ltd. (CN); Georg Fischer GmbH (DE); Georg Fischer Druckguss GmbH (AT); Georg Fischer GmbH & Co KG (AT)

( * ) Notice: Subject to any disclaimer, the term of this patent is extended or adjusted under 35 U.S.C. 154(b) by 0 days.

(21) Appl. No.: 15/378,137

(22) Filed: Dec. 14, 2016

(65) Prior Publication Data

US 2017/0174477 A1 Jun. 22, 2017

(30) Foreign Application Priority Data

Dec. 17, 2015 (EP) ..... 15200750

(51) Int. Cl.
*B66B 23/12* (2006.01)

(52) U.S. Cl.
CPC ..... *B66B 23/12* (2013.01)

(58) Field of Classification Search
CPC ..... B66B 23/12; B66B 21/04
USPC ..... 198/333, 327
See application file for complete search history.

(56) References Cited

U.S. PATENT DOCUMENTS

| | | | | |
|---|---|---|---|---|
| 5,988,350 | A * | 11/1999 | Nusime | B66B 23/12 198/333 |
| 6,405,848 | B1 * | 6/2002 | Babler | B66B 23/10 198/333 |
| 8,240,452 | B2 * | 8/2012 | Fischer | B66B 23/12 198/333 |

FOREIGN PATENT DOCUMENTS

| | | | |
|---|---|---|---|
| CN | 201056452 | Y | 5/2008 |
| DE | 29909808 | U1 | 9/1999 |
| EP | 2173652 | B1 | 12/2011 |
| JP | 2012201485 | A | 10/2012 |
| SU | 552268 | A1 | 3/1977 |
| WO | WO-2009047144 | A1 | 4/2009 |

OTHER PUBLICATIONS

European Search Report (in German) issued by the European Patent Office dated Jul. 5, 2016 regarding corresponding EP Application No. 15200750.6 (6 pages).

* cited by examiner

*Primary Examiner* — Gerald McClain
*Assistant Examiner* — Keith R Campbell
(74) *Attorney, Agent, or Firm* — Harness, Dickey & Pierce, P.L.C.

(57) ABSTRACT

Step for an escalator as well as the method for manufacturing the step, wherein the step is configured as a one-piece die-cast light metal part containing a step plate, a skirt, at least one transverse rib, guide lugs, wherein the guide lugs are fastened solely on the skirt, and drive lugs wherein the drive lugs are each arranged and fastened solely on the step with a connecting web.

8 Claims, 3 Drawing Sheets

BIONIC STEP

CROSS-REFERENCE TO RELATED APPLICATION

This application claims benefit and priority of European Patent Application No. 15 200 750.6 filed Dec. 17, 2015. The entire disclosure of the above application is incorporated herein by reference.

FIELD

The invention relates to a step for an escalator, wherein the step is configured as a one-piece die-cast light metal part containing a step plate, a skirt, at least one transverse rib, guide lugs, wherein the guide lugs are fastened solely on the skirt, and drive lugs.

BACKGROUND

Various types of designs for manufacturing and constructing steps for escalators are known from the prior art. The WO 2009/047144 A1 discloses a step which is comprised of deep-drawn sheet metal plates. This has the disadvantage of a complicated assembly which results in high costs.

The DE 299 09 808 U1 discloses a step which is made from glass fibre reinforced plastics and has several ribs and reinforcements for strengthening.

The EP 2 173 652 B1 discloses a step element which is made from die-cast aluminium and which is designed in one piece except for the strips.

The drawback with the step element mentioned above lies in the fact that a high material expense is required owing to the presence of braces to achieve the required strength and stability.

SUMMARY

It is an aspect of the invention to provide a step and a method connected therewith wherein the production costs are reduced owing to the reduction in materials and a shortening of the cycle time during the casting method but nevertheless meets the requirements for strength and stability.

This is achieved according to an aspect of the invention in that the drive lugs are each arranged or fastened on the step solely with a connecting web. The present invention is characterized in that material or casting material can be saved during manufacture of the step by dispensing with connecting or reinforcing braces. The steps known up until now in the prior art generally have a connecting web between the drive lug and the guide lug in order to obtain the required strength and stability of the step.

The step is preferably a die-cast light metal part which is formed in one piece. The step contains a step plate, a skirt, at least one transverse rib, wherein the transverse rib is preferably arranged on the underneath of the step plate and is intended to provide the required stability and strength of the step plate. The transverse rib preferably extends between the two connecting webs of the drive lugs and up to the peripheral regions of the step. The step furthermore comprises guide lugs wherein these are arranged or moulded solely on the skirt. The guide lugs are arranged in the two peripheral regions of the step.

The step according to the invention has a drive and guide lug on each of the two sides of the step, seen in the travelling direction, and/or in the peripheral regions of the step. The drive lug is connected to the drive chain of the escalator. The guide lug with a roller fixed thereon serves to guide the step and thus the escalator. The drive lug or the two drive lugs contained in a step, are each connected to the step solely by a connecting web. The drive lugs are not stabilized by any further web, they are each arranged and fastened on the step only by means of a connecting web. The drive lug can be configured as a closed ring and also as a ring segment open on one side.

Only the connecting web which is moulded on the step is continued at the drive lug. The connecting web for the drive lug is preferably arranged on the step plate of the step, and more especially preferred on the underneath of the step plate.

The step appears symmetrical, which is why it is not always especially mentioned that the step has two drive lugs and guide lugs as well as connecting webs. The drive lug and the guide lug of each peripheral region of the step preferably lie in alignment wherein this alignment runs in the travelling direction of the step.

The guide lugs are fastened or moulded on the step via the skirt. Since the lugs are each only connected to the step in one alignment and have no further braces and also no brace between the step plate and skirt the step is open downwards over the complete width.

This open configuration of the step enables a shortening of the cycle times during casting, since as a result thereof the mould and the casting tool can be configured more simply and in the best case scenario can even be formed by two half shells in order to remove the step from the mould after the casting process. This means that additional sliders on the casting tool can be dispensed with which results in a shortening of the cycle time.

In the case of struts additionally required on the step as known from the prior art two half shells are not sufficient to enable the step to be removed from the mould since rear cut sections are formed by such struts and can only be released by further sliders on the casting mould. This in turn increases the cycle time for opening a mould and removing the step therefrom, which has an impact with such a high number of steps which are to be produced.

Since the drive and guide lugs are not connected to one another nor underneath one another no strut runs inbetween and the step is thus configured open at the bottom over its complete width.

The step preferably has reinforcement ribs in the peripheral regions. The reinforcement ribs are to serve for strengthening and stabilizing the step. It is advantageous if the reinforcement ribs lie in the same alignment with the drive and guide lugs.

The reinforcement ribs run along the inside of the skirt and the underneath of the step plate and serve to increase the stability of the step and prevent the step plate from bending relative to the skirt. The reinforcement ribs moulded on the skirt and step plate have a radius in the transition from the region of the skirt into the region of the step plate. It has been shown to be advantageous if the reinforcement rib has a minimum height of 8 mm.

The reinforcement rib can also have different heights in the different regions, that is, the height of the reinforcement rib along the underneath of the step plate can amount by way of example to 10 mm and in the region of the inside of the skirt be only 8 mm, although obviously other combinations are possible.

DRAWINGS

An exemplary embodiment of the invention will be described with reference to the drawings, wherein the invention is not restricted to only the exemplary embodiment. In the drawings.

DETAILED DESCRIPTION

Figure 1:
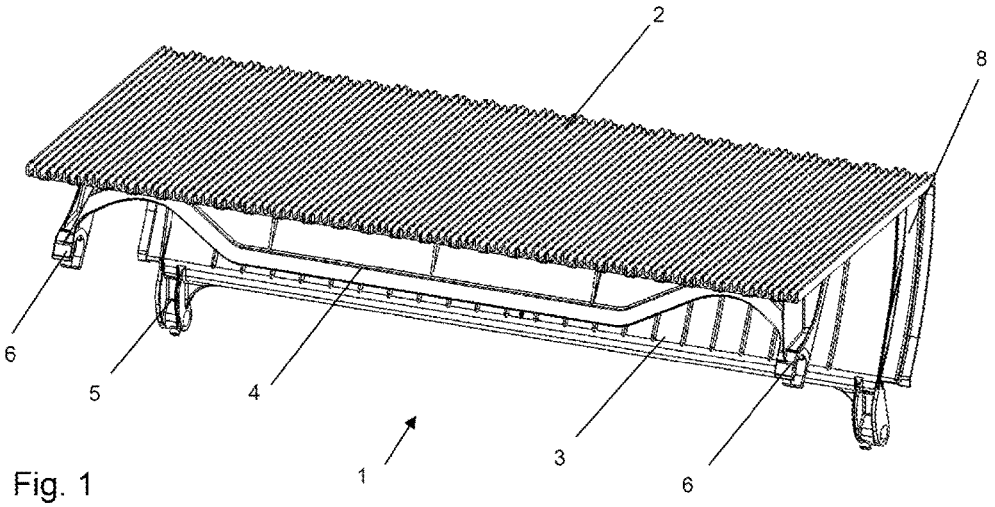
FIG. 1 shows a three-dimensional view of a step according to the invention.
Figure 2:
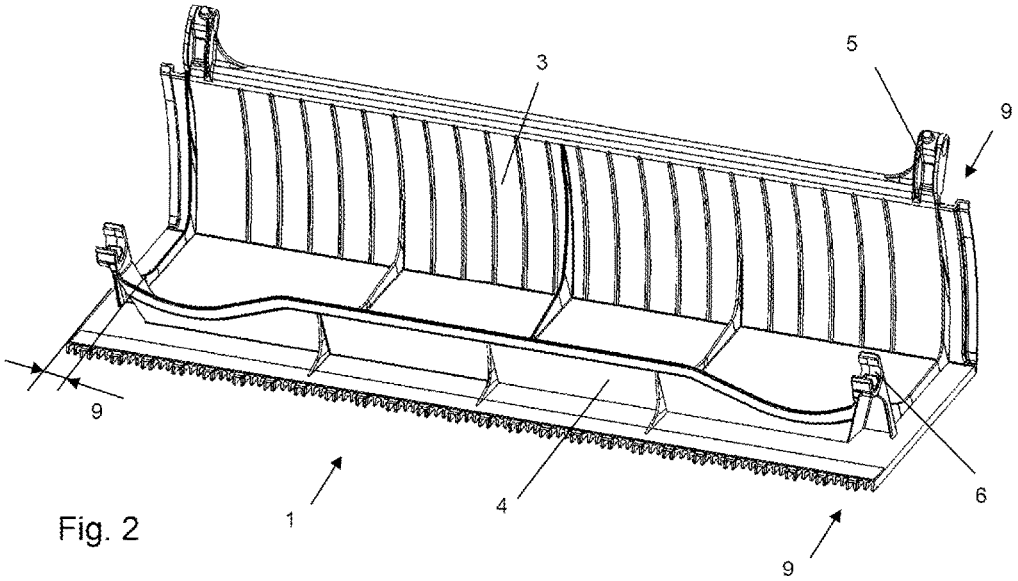
FIG. 2 shows a three-dimensional view of a step according to the invention, with the underneath facing upwards.
Figure 3:
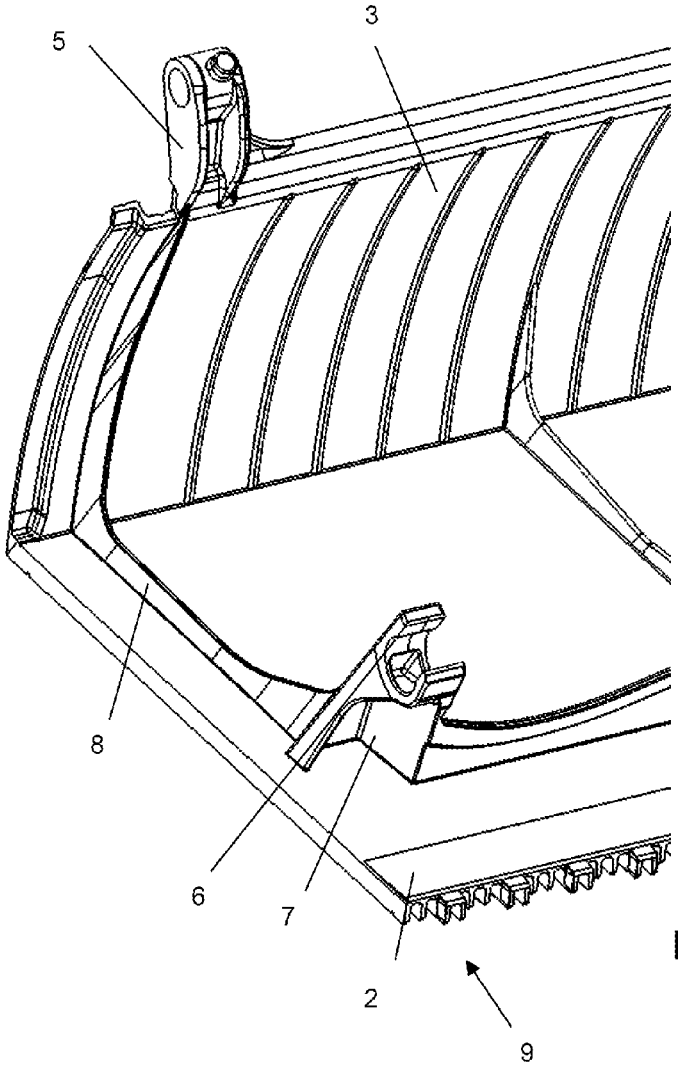
FIG. 3 shows a three-dimensional section of a step according to the invention, with the underneath facing upwards.
Figure 4:
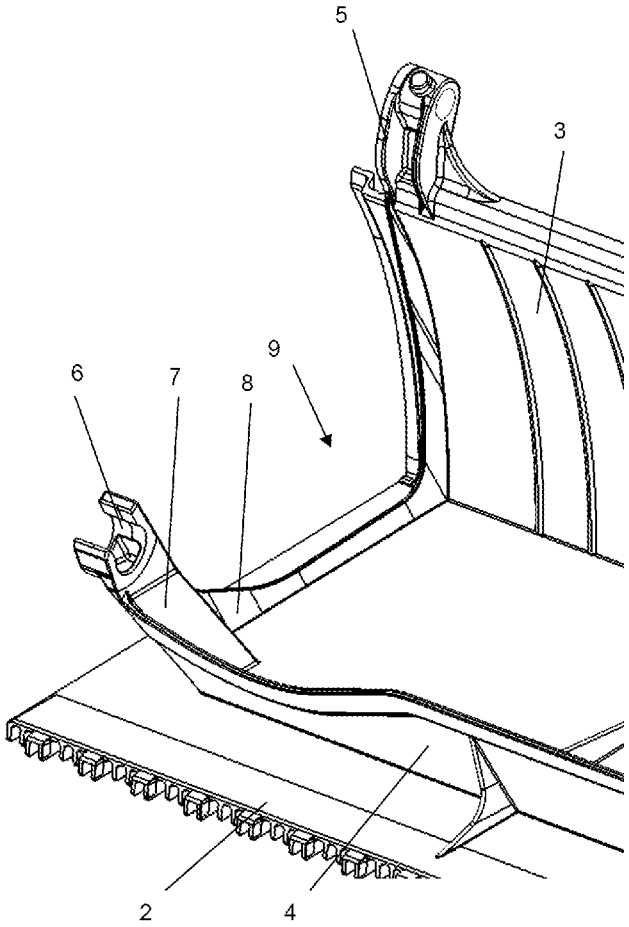
FIG. 4 shows a three-dimensional section of a step according to the invention from another view, with the underneath turned upwards.

FIG. 1 shows a three-dimensional view of a step 1 according to the invention for an escalator. The step 1 is configured as a one-piece die-cast light metal part whereby high completion costs for the individual steps can be avoided. The step 1 contains a step plate 2, a skirt 3, at least one transverse rib 4 for reinforcing the step plate 2, wherein the transverse rib 4 is preferably arranged on the underneath side of the step plate 2, guide lugs 5, wherein the guide lugs 5 are arranged solely on the skirt 3. This means that two guide lugs 5 are moulded and extend in the two peripheral regions 9 of the step 1, and/or skirt 3 of the step 1, seen in the travelling direction. These lugs serve to guide the step 1 and the escalator. The step 1 furthermore contains drive lugs 6 which are driven by means of the chain of an escalator, wherein the drive lugs 6 of the step 1 are each arranged in the two peripheral regions 9 of the step 1. The drive lugs 6 are each connected to the step 1 and formed on the step plate by means of a connecting web 7. The formation of the lugs 5, 6 is clearly shown in FIGS. 2-4 through the inverted view of the step 1.

The drive lugs 6 are preferably formed on the underneath of the step plate 2. The drive lugs 6 and the guide lugs 5 on the respective peripheral region 9 of the step 1 preferably lie in one alignment. The drive and guide lugs 5, 6 do not however have any connecting webs between them. Since there are also no connecting webs between the skirt 3 and step plate 2 the step 1 is open downwards over the entire width. This configuration of the step 1 enables a simple construction of the casting tool for producing the step 1. It is thereby possible to dispense with further sliders on the casting tool. This shortens the times for removing the step 1 from the mould. In order to ensure the required stability and strength of the step 1 despite the lack of braces between the skirt 3 and step plate 2 reinforcement ribs 8 are arranged in each of the two peripheral regions 9.

The reinforcement ribs 8 preferably run in the alignment of the drive and guide lugs 5, 6 of the respective peripheral region 9.

The reinforcement ribs 9 run along the inside of the skirt 3 and the underneath side of the step plate 2. The reinforcement ribs 8 run parallel to the travelling direction of the step 1 and escalator respectively.

The reinforcement ribs 8 extend along the skirt 3 and have a radius in the transition to the step plate 2.

The height of the reinforcement rib 8 is preferably at least 8 mm. The height of the reinforcement ribs 8 can also be different in the region of the skirt 3 and in the region of the step plate 2.

The skirt 3, the reinforcement ribs 8, the transverse rib 4 and the connecting webs 6 arranged between the transverse rib 4 and the reinforcement ribs 8 form a closed frame preferably on the underneath side of the step plate 2, whereby the required stability and strength of the step is achieved.

REFERENCE NUMERAL LIST

1 Step
2 Step plate
3 Skirt
4 Transverse rib
5 Guide lug
6 Drive lug
7 Connecting web
8 Reinforcement rib
9 Peripheral region

What is claimed is:

1. A step for an escalator comprising, wherein the step is configured as a one-piece die-cast light metal part comprising:

a step plate, a skirt, at least one transverse rib, guide lugs, wherein the guide lugs are fastened solely on the skirt, and drive lugs; and wherein the drive lugs are each fastened and arranged solely on the step with a connecting web.

2. A step for an escalator according to claim 1, wherein, the connecting webs of the drive lugs are arranged on the step plate.

3. A step for an escalator according to claim 1 wherein, the step is open downwards over the complete width.

4. A step for an escalator according to claim 1 wherein, there is no direct connection between the guide lugs and the drive lugs.

5. A step for an escalator according to claim 1 wherein, reinforcement ribs 8 are arranged between the skirt and the step plate in the peripheral regions of the step.

6. A step for an escalator according to claim 1 wherein, the drive and guide lugs of the respective peripheral region of the step lie in the same alignment wherein the alignment runs in the travelling direction.

7. A step for an escalator according to claim 1 wherein, the skirt, the reinforcement ribs, the transverse rib and the connecting webs between the transverse rib and the reinforcement ribs form a closed frame, on the underneath side of the step plate.

8. A method for manufacturing a step according to claim 1, wherein, the step is produced as a one-piece part in the light metal die-casting process.

* * * * *